US007533784B2

(12) United States Patent
Vlastakis et al.

(10) Patent No.: US 7,533,784 B2
(45) Date of Patent: May 19, 2009

(54) THEFT DETERRENT SYSTEM HOOK

(75) Inventors: Kirk Vlastakis, Clemmons, NC (US); Roger Miller, East Bend, NC (US); Thomas Lockwood, Clemmons, NC (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 79 days.

(21) Appl. No.: 11/761,847

(22) Filed: Jun. 12, 2007

(65) Prior Publication Data

US 2007/0283615 A1 Dec. 13, 2007

Related U.S. Application Data

(60) Provisional application No. 60/812,832, filed on Jun. 12, 2006.

(51) Int. Cl.
*A01K 97/04* (2006.01)

(52) U.S. Cl. ..... 221/258; 221/3; 221/151; 221/153; 221/289; 43/55

(58) Field of Classification Search ..... 221/1, 221/2, 3, 15, 25, 34, 92, 109, 151, 152, 153, 221/154, 186, 187, 188, 191, 192, 193, 194, 221/195, 196, 200, 202, 203, 204, 205, 208, 221/209, 221, 222, 223, 224, 226, 227, 230, 221/231, 232, 234, 235, 255, 256, 257, 258, 221/261, 268, 270, 271, 272, 273, 275, 276, 221/277, 279, 280, 283, 289, 311; 211/4, 211/7, 8

See application file for complete search history.

(56) References Cited

U.S. PATENT DOCUMENTS

| | | | | |
|---|---|---|---|---|
| 691,990 | A | | 1/1902 | Warren |
| 1,034,318 | A | | 7/1912 | Sobretto et al. |
| 1,123,071 | A | * | 12/1914 | Bell ..... 194/286 |
| 1,319,084 | A | | 10/1919 | Hume |
| 1,533,147 | A | | 4/1925 | Svendsgaard |
| 1,592,720 | A | | 7/1926 | Butler |
| 1,614,363 | A | | 1/1927 | Hicks |
| 1,680,275 | A | | 8/1928 | Albaugh |
| 1,755,655 | A | | 4/1930 | Langenfeld |
| 1,813,935 | A | | 7/1931 | Knee |

(Continued)

FOREIGN PATENT DOCUMENTS

DE 20 2005 010 088 U1 10/2005

(Continued)

*Primary Examiner*—Gene Crawford
*Assistant Examiner*—Kelvin L Randall, Jr.
(74) *Attorney, Agent, or Firm*—Kilpatrick Stockton LLP

(57) ABSTRACT

There is provided an apparatus for dispensing products that includes a theft deterrent retail product dispensing hook. In certain embodiments, the hook prevents product "sweeping" (where a thief quickly empties a conventional retail hook of product) and also delivers a time-delayed delivery of product per hook. A specific embodiment of a time-delay display hook system comprises a two-prong system having an upper member and a lower member, with the upper member supporting a dispensing system and the lower member supporting a product to be dispensed. Upon triggering of an activation member, the dispensing system releases a single product and provides a time-delay between dispensing of further product.

20 Claims, 5 Drawing Sheets

U.S. PATENT DOCUMENTS

| | | | | |
|---|---|---|---|---|
| 1,841,926 | A | 1/1932 | Wray | |
| 1,913,843 | A | 6/1933 | Marcuse | |
| 2,142,053 | A | 12/1938 | Hoban | |
| 2,163,280 | A | 6/1939 | Hibshman | |
| 2,304,533 | A | 12/1942 | Bright | |
| 2,412,368 | A | 12/1946 | Tascher | |
| 2,824,666 | A | 2/1958 | Hausladen | |
| 2,977,023 | A | 3/1961 | Meyer | |
| 3,161,295 | A | 12/1964 | Chesley | |
| 3,199,724 | A | 8/1965 | Domenico et al. | |
| 3,313,448 | A | 4/1967 | Howard et al. | |
| 3,351,233 | A | 11/1967 | Chanoch et al. | |
| 3,452,899 | A | 7/1969 | Libberton | |
| 3,578,207 | A | 5/1971 | Danow | |
| 3,583,568 | A | 6/1971 | Crossien | |
| 3,591,048 | A * | 7/1971 | Myers | 221/277 |
| 3,749,279 | A | 7/1973 | Ungerman | |
| 3,752,357 | A | 8/1973 | Harris | |
| 3,776,418 | A | 12/1973 | Bookout | |
| 3,796,345 | A * | 3/1974 | Fessler | 221/67 |
| 3,805,962 | A | 4/1974 | Bendiksen | |
| 3,923,159 | A * | 12/1975 | Taylor et al. | 211/59.2 |
| 3,957,173 | A | 5/1976 | Roudebush | |
| 3,968,900 | A | 7/1976 | Stambuk | |
| 4,007,853 | A | 2/1977 | Bahneman | |
| 4,010,869 | A | 3/1977 | Adamo | |
| 4,018,100 | A | 4/1977 | Moe | |
| 4,190,179 | A | 2/1980 | Moss et al. | |
| 4,228,903 | A | 10/1980 | Eckert | |
| 4,275,819 | A | 6/1981 | Perez | |
| 4,308,974 | A | 1/1982 | Jones | |
| 4,336,892 | A | 6/1982 | Cox et al. | |
| 4,371,093 | A | 2/1983 | Berger | |
| 4,412,607 | A | 11/1983 | Collins et al. | |
| 4,474,300 | A | 10/1984 | Entis | |
| 4,576,272 | A | 3/1986 | Morgan et al. | |
| 4,679,684 | A | 7/1987 | Glaser | |
| 4,682,826 | A | 7/1987 | Mestdagh | |
| 4,779,760 | A * | 10/1988 | Wittern et al. | 221/283 |
| 4,852,767 | A | 8/1989 | Humphrey | |
| 4,887,737 | A | 12/1989 | Adenau | |
| 4,954,760 | A | 9/1990 | Futch et al. | |
| 4,962,867 | A | 10/1990 | Ficken et al. | |
| 5,046,641 | A | 9/1991 | Gray | |
| 5,067,634 | A | 11/1991 | Guindulain Vidondo | |
| 5,096,367 | A | 3/1992 | Winski | |
| 5,111,942 | A | 5/1992 | Bernardin | |
| 5,121,854 | A | 6/1992 | Trouteaud et al. | |
| 5,150,101 | A | 9/1992 | Goris et al. | |
| 5,169,027 | A | 12/1992 | Falk et al. | |
| 5,199,598 | A | 4/1993 | Sampson | |
| 5,229,749 | A | 7/1993 | Yenglin | |
| 5,249,705 | A | 10/1993 | Gates | |
| 5,252,948 | A | 10/1993 | Goris et al. | |
| 5,263,596 | A | 11/1993 | Williams | |
| 5,285,926 | A | 2/1994 | Falk et al. | |
| 5,335,616 | A | 8/1994 | Kaufman et al. | |
| 5,335,818 | A | 8/1994 | Maldanis | |
| 5,360,134 | A | 11/1994 | Falk | |
| 5,375,735 | A | 12/1994 | Huvey et al. | |
| 5,376,737 | A | 12/1994 | Ficken | |
| 5,397,025 | A * | 3/1995 | Lee | 221/299 |
| 5,400,919 | A | 3/1995 | Gomm et al. | |
| 5,462,198 | A | 10/1995 | Schwimmer | |
| 5,632,408 | A | 5/1997 | Mitchell | |
| 5,665,304 | A | 9/1997 | Helnen et al. | |
| 5,709,315 | A | 1/1998 | Kahler et al. | |
| 5,790,409 | A | 8/1998 | Fedor et al. | |
| 5,813,568 | A | 9/1998 | Lowing | |
| 5,960,984 | A | 10/1999 | Weston | |
| 5,960,988 | A | 10/1999 | Freixas | |
| 6,131,748 | A * | 10/2000 | Kawasaki et al. | 211/54.1 |
| 6,176,558 | B1 | 1/2001 | Hlade et al. | |
| 6,196,416 | B1 | 3/2001 | Seagle | |
| 6,199,720 | B1 | 3/2001 | Rudick et al. | |
| 6,206,237 | B1 | 3/2001 | Dillon et al. | |
| 6,263,259 | B1 | 7/2001 | Bartur | |
| 6,318,591 | B1 | 11/2001 | Martin | |
| 6,325,242 | B1 | 12/2001 | Izawa et al. | |
| 6,474,478 | B1 | 11/2002 | Huchner et al. | |
| 6,478,187 | B2 | 11/2002 | Simson et al. | |
| 6,520,604 | B1 | 2/2003 | Yasaka et al. | |
| 6,581,798 | B2 | 6/2003 | Liff et al. | |
| 6,601,416 | B1 | 8/2003 | Sanders | |
| 6,604,652 | B1 | 8/2003 | Trautwein | |
| 6,622,979 | B2 | 9/2003 | Valiulis | |
| 6,659,291 | B2 * | 12/2003 | Huehner et al. | 211/4 |
| 6,691,891 | B2 | 2/2004 | Maldonado | |
| D491,403 | S | 6/2004 | Gervasi | |
| 6,758,370 | B2 | 7/2004 | Cooke et al. | |
| 6,776,304 | B2 | 8/2004 | Liff et al. | |
| 6,786,341 | B2 | 9/2004 | Stinnett et al. | |
| 6,814,254 | B2 | 11/2004 | Liff et al. | |
| 6,814,255 | B2 | 11/2004 | Liff et al. | |
| 6,857,539 | B2 | 2/2005 | Parra | |
| 6,892,898 | B1 | 5/2005 | Boone et al. | |
| 6,957,555 | B1 | 10/2005 | Nagel et al. | |
| 7,007,810 | B2 | 3/2006 | Huehner et al. | |
| 7,024,894 | B2 | 4/2006 | Salonen | |
| 7,032,776 | B2 | 4/2006 | Hieb | |
| D521,363 | S * | 5/2006 | Copen et al. | D8/363 |
| 7,128,239 | B2 | 10/2006 | Skavnak | |
| 7,149,600 | B2 | 12/2006 | Rippolone | |
| 7,151,982 | B2 | 12/2006 | Liff et al. | |
| 7,178,678 | B2 | 2/2007 | Mansfield et al. | |
| 7,197,902 | B1 | 4/2007 | Barkdoll | |
| 7,207,447 | B2 | 4/2007 | Medcalf et al. | |
| 7,213,722 | B2 | 5/2007 | Nagelski et al. | |
| 7,249,761 | B2 | 7/2007 | Graef et al. | |
| 7,264,138 | B2 | 9/2007 | Collins et al. | |
| 7,269,983 | B1 | 9/2007 | Mchatet | |
| 7,293,672 | B2 | 11/2007 | Mori | |
| 7,303,095 | B2 | 12/2007 | Nagelski | |
| 2003/0029816 | A1 | 2/2003 | Huchner et al. | |
| 2003/0121929 | A1 | 7/2003 | Liff et al. | |
| 2003/0178435 | A1 | 9/2003 | Yamaguchi | |
| 2003/0189058 | A1 | 10/2003 | Liff et al. | |
| 2004/0026344 | A1 * | 2/2004 | Sedon et al. | 211/7 |
| 2004/0059464 | A1 | 3/2004 | Veenstra et al. | |
| 2004/0060944 | A1 | 4/2004 | Gervasi | |
| 2004/0084386 | A1 | 5/2004 | Huchner et al. | |
| 2004/0104239 | A1 | 6/2004 | Black et al. | |
| 2004/0149768 | A1 | 8/2004 | Scoville et al. | |
| 2004/0238557 | A1 | 12/2004 | Chirnomas | |
| 2005/0029205 | A1 * | 2/2005 | Mansfield et al. | 211/7 |
| 2005/0029283 | A1 * | 2/2005 | Pedigo | 221/289 |
| 2005/0065645 | A1 | 3/2005 | Liff et al. | |
| 2005/0189369 | A1 | 9/2005 | Vlastakis | |
| 2005/0189370 | A1 | 9/2005 | Carter et al. | |
| 2005/0199644 | A1 | 9/2005 | Barili et al. | |
| 2005/0205596 | A1 | 9/2005 | Kelly | |
| 2005/0252925 | A1 | 11/2005 | Kelly | |
| 2006/0157431 | A1 | 7/2006 | Nagelski et al. | |
| 2006/0219730 | A1 | 10/2006 | Handfield et al. | |
| 2006/0237381 | A1 * | 10/2006 | Lockwood et al. | 211/59.3 |
| 2006/0266762 | A1 | 11/2006 | Andrews et al. | |
| 2007/0029340 | A1 | 2/2007 | Nagelski et al. | |
| 2007/0078561 | A1 | 4/2007 | Sansone | |
| 2007/0080175 | A1 | 4/2007 | Peterson | |
| 2007/0119796 | A1 | 5/2007 | Barkdoll | |
| 2007/0221679 | A1 | 9/2007 | Chandler et al. | |

| | | | |
|---|---|---|---|
| 2007/0273513 | A1 | 11/2007 | White |
| 2007/0278164 | A1 | 12/2007 | Lang et al. |

FOREIGN PATENT DOCUMENTS

| | | | |
|---|---|---|---|
| DE | 20 2005 019 621 | U1 | 3/2006 |
| DE | 20 2007 011 927 | U1 | 12/2007 |
| EP | 1 541 064 | B1 | 6/2005 |
| JP | 01144185 | | 6/1989 |
| JP | 02219194 | | 8/1990 |
| JP | 09319937 | | 12/1997 |
| JP | 2005049965 | | 1/2005 |
| JP | 2006285930 | | 10/2006 |
| WO | WO 8912873 | | 12/1989 |
| WO | WO 2007/054042 | A1 | 5/2007 |
| WO | WO 2006/085211 | A1 | 8/2007 |

* cited by examiner

THEFT DETERRENT SYSTEM HOOK

This application claims the benefit of U.S. Provisional Application Ser. No. 60/812,832, filed Jun. 12, 2006 titled "Theft Deterrent Hook System," the entire contents of which are hereby incorporated by reference.

BACKGROUND OF THE INVENTION

1. Field of the Invention

The invention relates generally to theft deterrent devices for dispensing products. More specifically, the invention relates to dispensing devices that incorporate theft deterrent measures, such as knobs and time delays.

2. General Background

Theft of small items in retail stores is an all too common problem. Items that are in high demand by thieves include over-the-counter (OTC) products such as analgesics and cough and cold medications, razor blades, camera film, batteries, videos, DVDs, smoking cessation products and infant formula. Shelf sweeping is a particular problem for small items. It occurs when someone removes all the shelf stock (and in some instances, removes the hook on which the merchandise is hanging), and exits the store, similar to a "smash and grab" shoplifting technique. Shelf sweeping relies on excessive quantities of product being available on the shelf. However, retailers need to keep substantial inventory on shelf or incur the cost of constantly restocking.

In addition to preventing theft, retail stores may want to limit the purchase of certain items. For example, to make methamphetamine, large quantities of cold medication are needed. Pseudoephedrine, the sole active ingredient in many cold medicines and decongestants, is also a key ingredient in methamphetamine, a powerful and highly addictive stimulant.

Retailers are constantly challenged to balance the needs of legitimate consumers' access to high theft items with measures to minimize the incidence of theft. It has long been known to place items such as cigarettes, sodas and newspapers in vending machines. Such machines require complete self-service by the customer. The customer places money into the vending machine and the machine dispenses the desired item. However, vending machines may be inconsistent with the way that people currently purchase items; many people prefer to use credit or debit cards instead of cash. Vending machines may also be inconvenience and occupy a great deal of space. Finally, typical vending machines do not employ any time delay mechanism to prevent a purchaser from quickly dispensing all the items in the vending machine.

Because theft has become so rampant in certain product categories, such as razors, infant formula, and cold medicine, many retail stores are taking the products off the shelves and placing them behind the counter or under lock-and-key. Customers must request the products in order to make a purchase. This requires additional labor costs to provide individual service to customers who would normally not require it. It also makes it difficult for customers to compare products. Furthermore, it may be impossible where the space behind the counter is limited and is needed for prescription medications. In some cases, some products are simply unavailable due to high pilferage rates.

Therefore, a device or dispensing apparatus that minimizes the incidence of product theft, particularly sweeping, is needed. The device or dispensing apparatus should also be able to fit within common grocery, drug store or other retail environment shelves. It is also desirable that the device or dispensing apparatus effectively display the products so consumers can easily identify the products. It is also preferable that the dispensing apparatus be easy to use.

Additionally, studies have shown that in addition to preventing sweeping, another desirable form of theft deterrence is to cause a time delay between the dispensing of multiple products. Would-be thieves are less likely to steal products if there is a substantial delay between the dispensing of individual products. It is also desirable to achieve time delayed dispensing of products in a cost effective manner.

BRIEF SUMMARY OF THE INVENTION

In certain embodiments of the invention, the apparatus for dispensing products includes a theft deterrent retail product-dispensing hook. In certain embodiments, the hook prevents product "sweeping" (where a thief quickly empties a conventional retail hook of product) and also delivers a time-delayed delivery of product per hook.

For example, a specific embodiment of a time-delay display hook system, comprises a two-prong system having an upper member and a lower member, the upper member adapted to support a dispensing system and the lower member adapted to support product to be dispensed; a dispensing system associated with the upper member that comprises a motor, a blocking member, and an activation member, wherein the activation member is adapted to be triggered to release a product to be dispensed from the lower member. Upon triggering of the activation member, the blocking member is activated to prevent further product from being dispensed and the motor is activated to prevent further turning of the activation member until the motor times out, providing a time-delay between dispensing of individual products.

DETAILED DESCRIPTION

Figure 1:
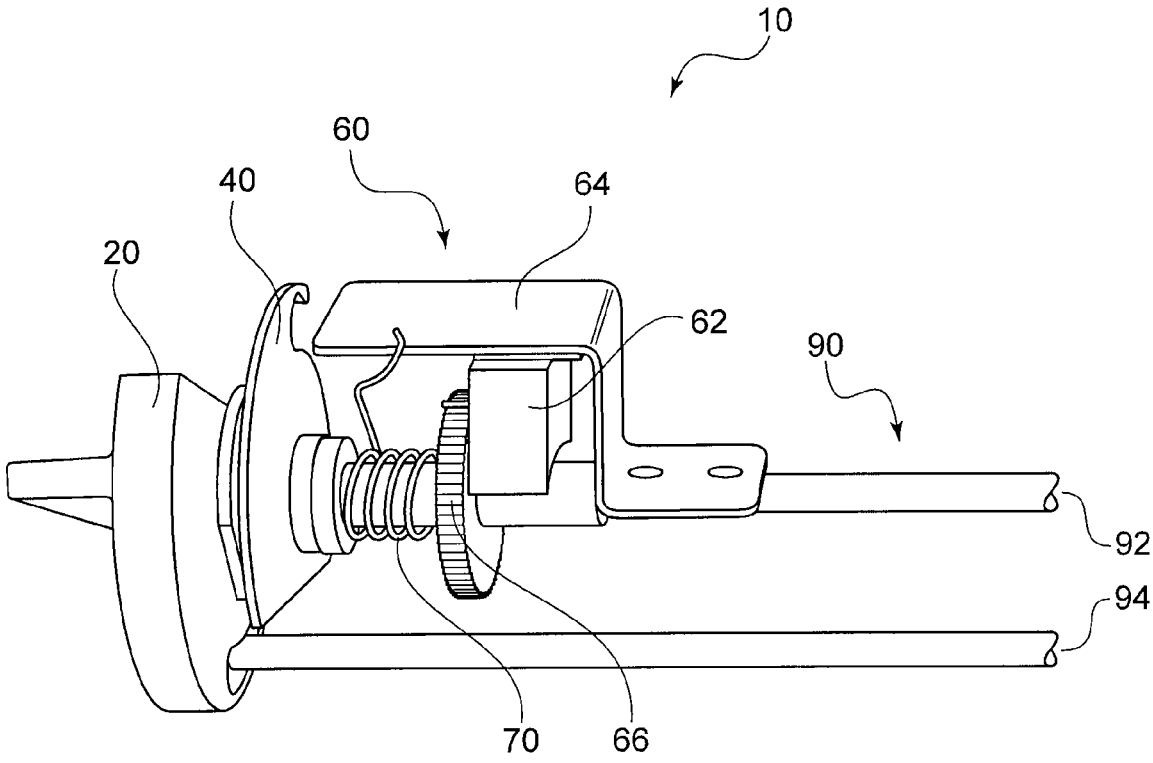
FIG. 1 shows a side perspective view of one embodiment of a theft deterrent hook system.

As shown in FIG. 1 and described in more detail below, embodiments of the invention provide a two-prong system with a dispensing system on the upper member of the hook. The dispensing system is a spring-loaded rotary gate system, actuated by a customer turning an activation member or a knob, allowing one gate (which may be a part of knob or a separate element) to permit the forward-most product to be vended while the second gate (which may be a blocking member) prevents a subsequent product from being vended until the spring-loaded timing device re-sets itself.

Thus, the time-delay of the dispensing system provides a theft deterrent feature. In addition to the product-dispensing aspect of the device, there is provided a key/lock provision on the activation member or knob that allows a retailer to re-position the forward gate (activation member or knob) and allow product to be loaded on to the hook by a retail attendant and then locked in the position that allows for vending. The key/lock may also be used to completely lock the device during high theft times.

Figure 2:
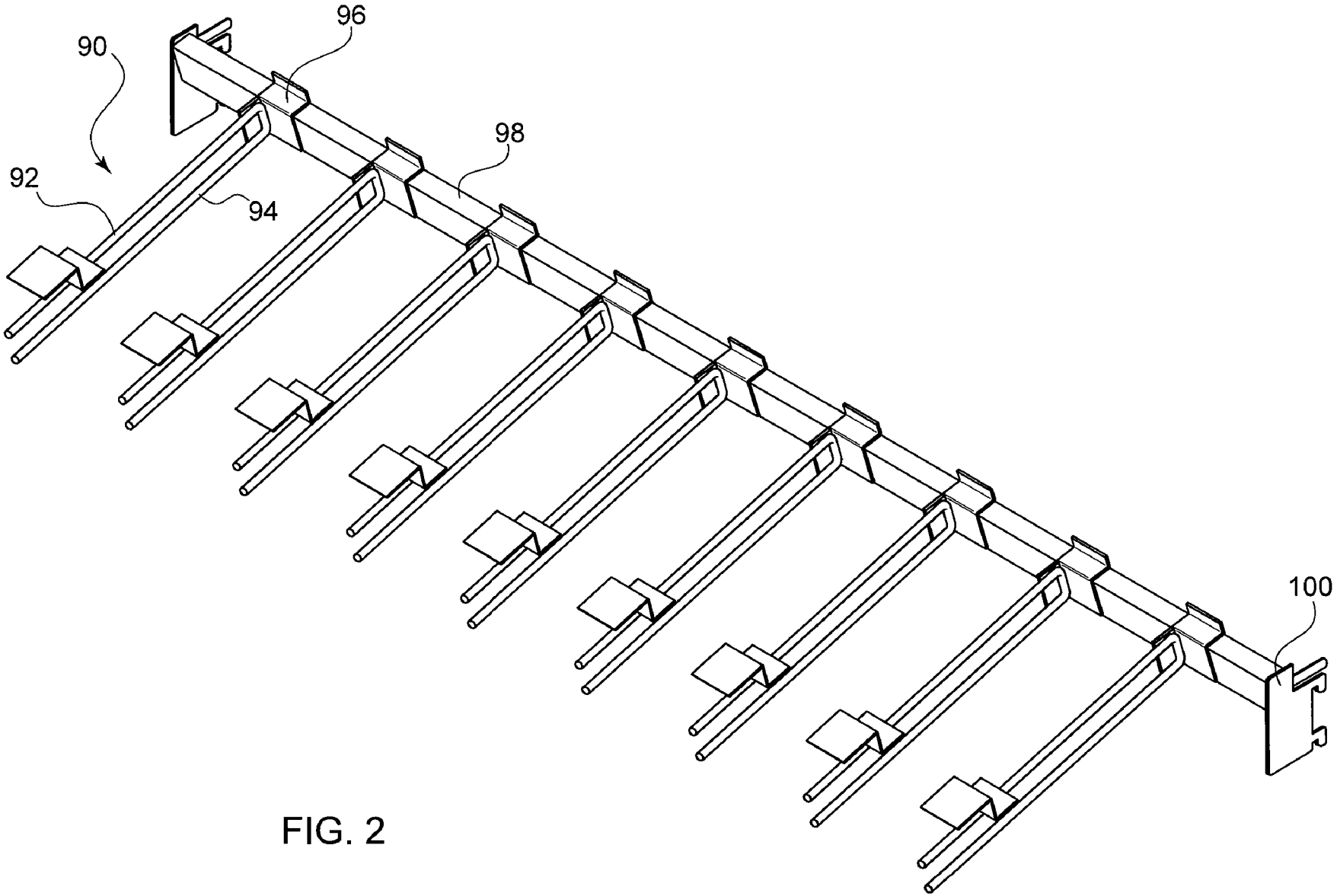
FIG. 2 shows an exemplary mounting system and a two-prong for a theft deterrent hook system.

First, as shown in FIG. 2, there is provided a two-prong system 90. Hook 90 includes an upper member 92 and a lower member 94. Members may be attached to a mounting member 96, which may in turn, mount member to a display board, a cross bar 98, or any other structure. If provided, cross-bar 98 may be attached to an in-store shelf backing by a hanger 100 or any other appropriate attachment mechanism. One advantage of a cross-bar mounting system is that it allows adjustability to the left to right. Another advantage is that it ensures that the connection of the hook 90 to the cross-bar 98 is sound. Present devices rely on pegboard backer which can easily be broken. Another advantage is that incorporating a mounting member 96 to the hook can help connect the hook to a pre-existing in-store retail fixture. Additionally, mounting systems according to various embodiments help impart strength and lower the risk of would-be-thieves from easily removing the system from a shelf. (An additional built-in theft deterring mechanism is a time delay between the dispensing of products, discussed below.) This system may be constructed of tubular steel or any other conventional materials.

The embodiment of theft-deterring device 10 shown in FIG. 1 includes a two-prong system 90 associated with a dispensing system 60. The dispensing system 60 may be associated with the upper member 92, so that the lower member 94 can support product to be dispensed. Dispensing system 60 is a spring-loaded rotary gate system that allocates only one product at a time, with a time delay between each product dispensing action.

Each of these elements will be discussed in more detail below, but in a specific embodiment, the dispensing system 60 is actuated by the activation of an activation member 20 (which may a knob, a lever, a push button, a pull button, or any other device that may be used to activate a motor), which releases the lower member 94 from the knob 20 and allows a single product to be removed. That motion also rotates a blocking member 40 or gate that prevents all other products on the member from being removed. The turning motion also loads a spring 70 that will begin to rotate and actuate a motor 62 once the activation member 20 (which is shown as a knob in the figures) is released. As the spring-loaded system begins to unwind (guided by a gear and resistance motor), there is a point at which the blocking member 40 will allow another product to gravity feed forward to a position between the blocking member 40 and the activation member 20. This product, and only this product, is in a position to be accessed by another rotation of the activation member 20.

Figure 3A:
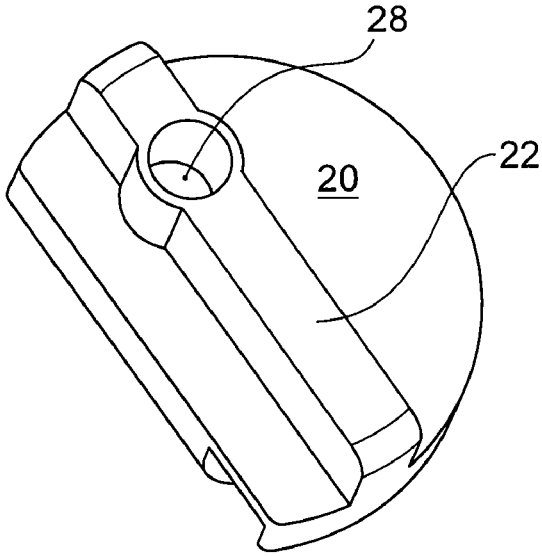
FIGS. 3A and 3B show one embodiment of an activation member or knob for a theft deterrent hook system.
Figure 3B:
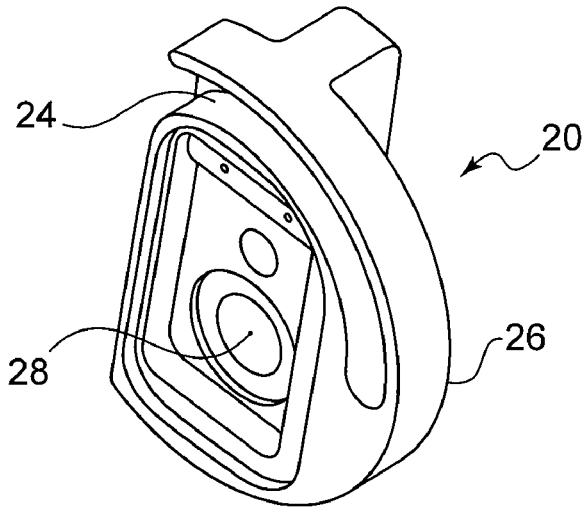

Turning now to the other specific components of the system, one embodiment of activation member 20 is shown in FIGS. 3A and 3B as a knob 20. FIG. 3A shows the side of knob 20 that faces consumer, which has a portion 22 to be grasped. As shown in FIG. 3B, knob 20 also has a dispensing groove 24, which generally follows at least a portion of circumference 26 of knob 20. In use, dispensing groove 24 releases the end of lower member 94, which allows the consumer to remove the product. Knob 20 also has a connecting member 28, which allows it to be connected to upper member 92 and/or the spring-loaded system 60. Connecting member 28 is shown as a circular opening, but it should be understood that any connection mechanism of any shape and size that will allow knob to connect to the rest of device 10 (e.g., a peg, a ratcheted system, etc.) is considered within the scope of this invention.

Figure 4:
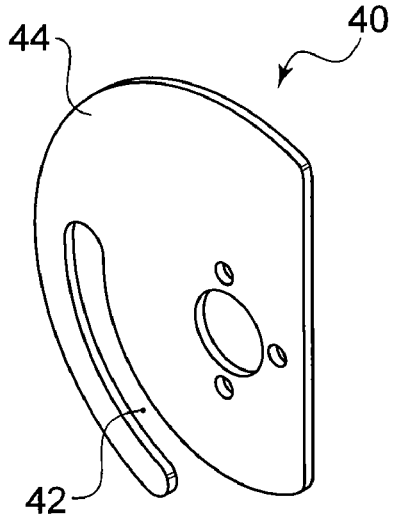
FIG. 4 shows one embodiment of a blocking member for a theft deterrent hook system.

Once knob 20 is turned, blocking member 40 moves into a position that blocks product from sliding down lower member 94. As shown in FIG. 4, blocking member 40 has a shape similar to the shape of knob 20. Its groove 42 moves to the position to release product only after the motor has timed out. In one embodiment, the motor action may slowly rotate blocking portion 44 around in order to allow groove 42 to release product once motor has timed out. In another embodiment, blocking portion 44 remains stationary during the motor action, and the groove 42 snaps back into place once the motor times out, allowing product to gravity feed.

Knob 20 and blocking member 40 are attached to a spring/motor combination. As shown in FIG. 1, one end of spring 70 is preferably attached to the motor mount 64 (which provides resistance for spring's action) and the other end is attached to a resistance motor 62 and gear 66 system. The turning of knob 20 tightens and loads spring 70, while the motor and gear system are allowed to freewheel. Once the knob 20 is released, the spring tension activates resistance motor 62. In a certain embodiment, the resistance motor 62 is of the type commonly used in toy cars, so that is can be wound up and then un-wound to create energy or movement. The resistance motor 62 may incorporate a series of gears 66 which prevent the blocking member 40 and knob 20 from returning to the dispensing mode until a period of time has passed, such as approximately 15 or 30 seconds. Thus, one advantage of the devices described is that in addition to preventing sweeping of multiple products while the single item is dispensing, they also provide a time-delay in between each dispensing step. This time delay may be any desired time, for example from about 5 to about 60 seconds. (Much longer may prevent legitimate consumers from purchasing product, although any time limit is possible.)

As the spring loaded dispensing system 60 begins to unwind, there becomes a point at which the blocking member 40 allows a product to gravity feed forward to a position in between the blocking member 40 and the knob 20. This is the only product that is allowed to move forward to a staging position to be accessed by another rotation of the knob 20.

Figure 5:
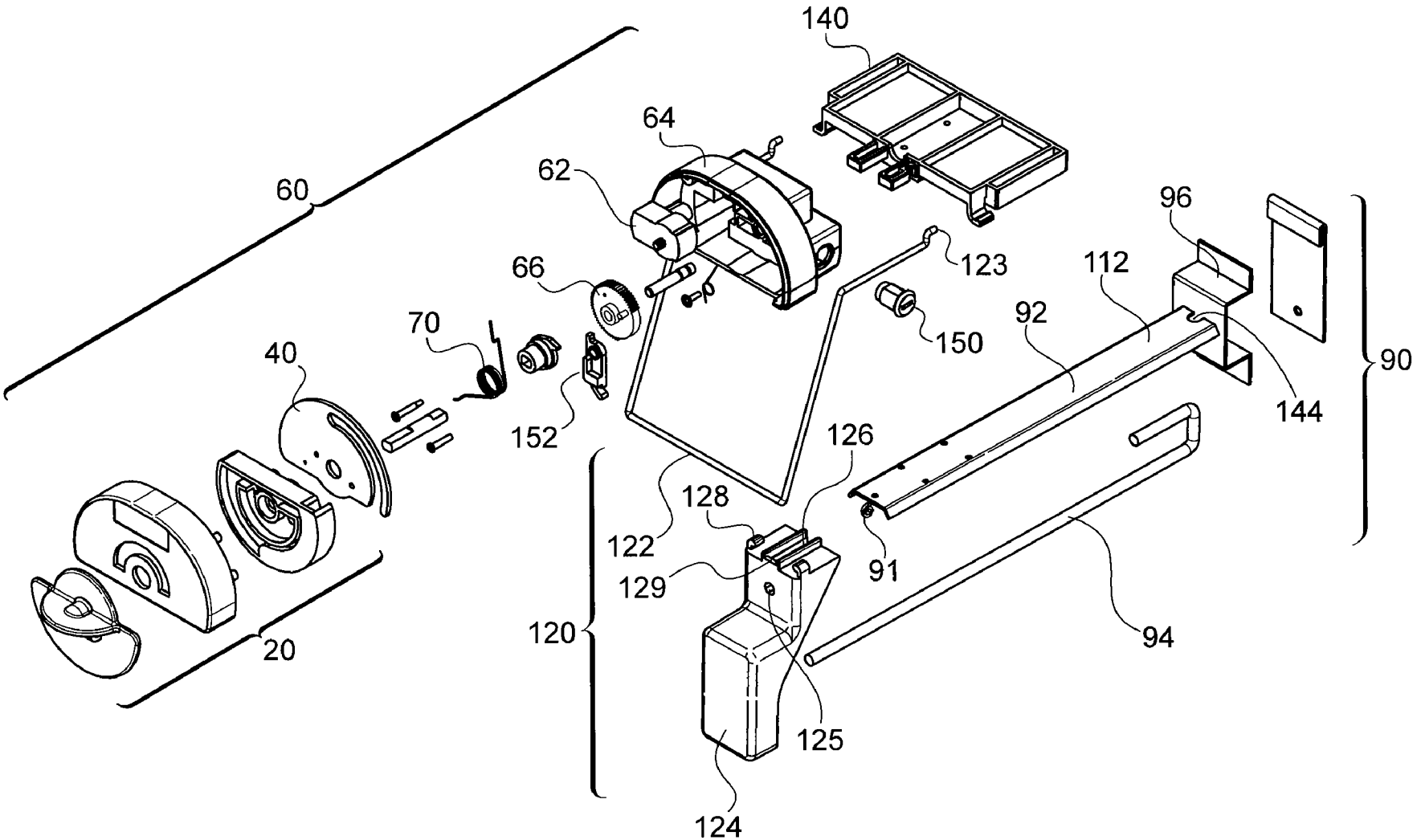
FIG. 5 shows an exploded perspective view of an alternate embodiment of a theft deterrent system.

FIG. 5 shows an exploded perspective view of an alternate embodiment of device 10. This embodiment includes activation member 20, blocking member 40, spring 70, motor 62, and gear 66. It also features a motor mount 64, which covers motor 62, that prevents contaminants from entering the dispensing system 60, and gives the device 10 a more polished look. This embodiment also has a dispensing bar system 120 that can hold and support product, if desired. The dispensing bar system 120 includes a support bar 122 and a support pusher 124. In addition to providing a supportive back for product, support pusher 124 is spring loaded and helps to push product forward. In one embodiment, upper member 92 has a spring-coiled member 91 on its underneath portion and support pusher 124 has an engaging system 126 that cooperates with upper member 92. The engaging system 126 may feature outer arms 128 that are adapted to receive ends 93 of upper member 92. Engaging system 126 may also have an inner track 129 track that engages with a spring coiled-member 91 on the underneath side of upper member 92. As product is allowed to move forward due to the action of the motor, spring coiled-member 91 forces support pusher 124 forward. Support pusher 124 also has an opening 125 that receives lower member 94 in use. Support pusher is particularly useful in systems that are not gravity feed systems, although gravity feed systems may also use the theft deterrent hook features described herein.

Figure 6:
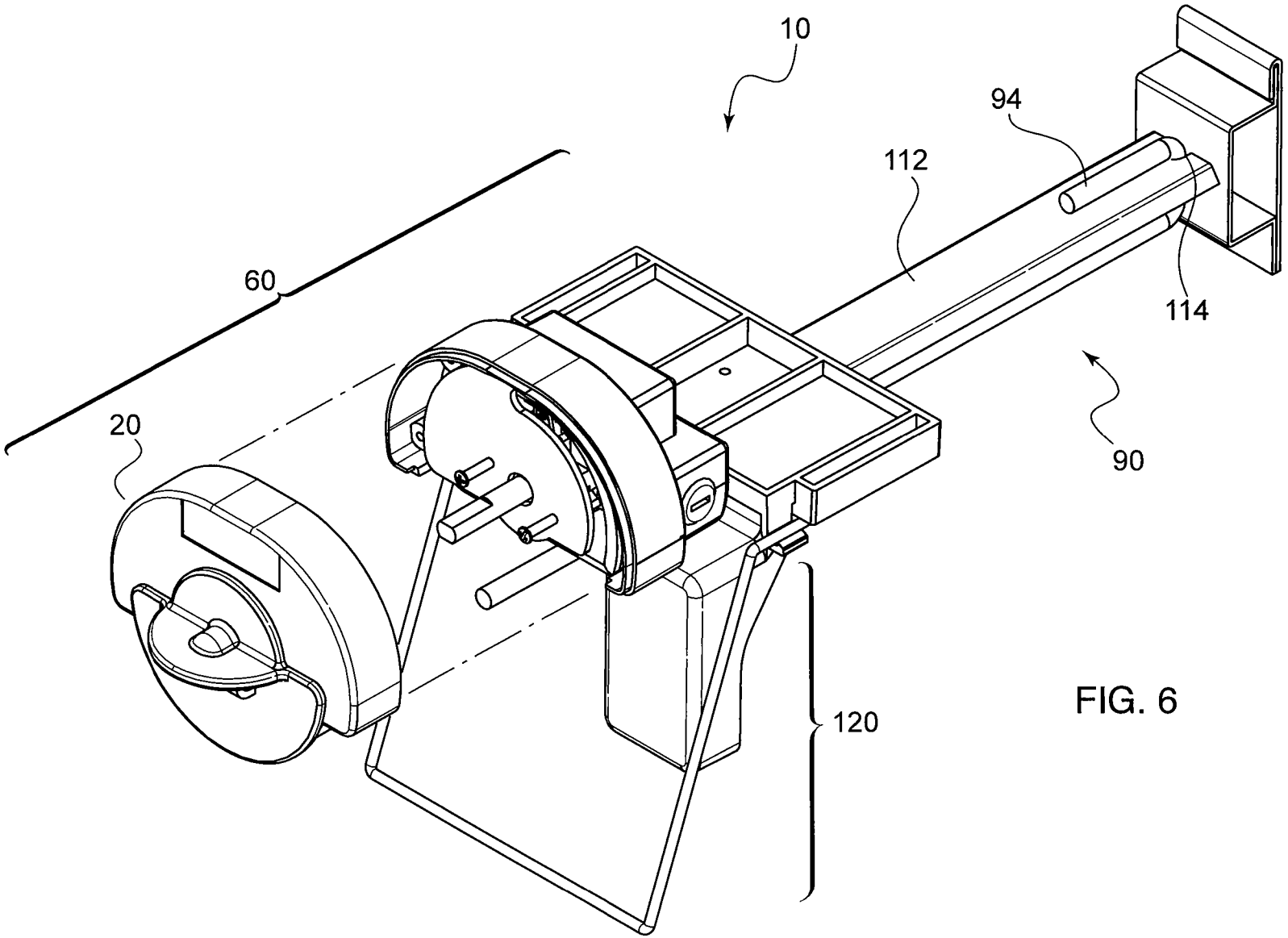
FIG. 6 shows the system of FIG. 5 in a partially assembled position, with the activation member being put into place.

Also, in this embodiment, rather than being a circular rod, upper member 92 is shown as a flat bar 112. Flat bar 112 may be integrally connected to a mounting member or it may be formed as a separate piece, depending upon display requirements. As shown in FIGS. 5 and 6, flat bar 112 may have an opening 114 that receives lower member 94, which may hold the elements more securely and conveniently together.

Another beneficial feature of device 10 is that support bar 122 may be adjusted to receive variously-sized product. As shown in FIG. 5, a support member 140 may be provided that can be mounted onto flat bar 112. Support member 140 has adjustable openings on its underneath side that allow prongs 123 of support bar 122 to be received at different locations to provide more or less space for product in the area between support pusher 124 and support bar 122. (This can be seen more clearly on FIG. 6.)

A further feature of device 10 is that dispensing system 60 may be removed from the two-prong system 90 for restocking purposes. Once assembled, dispensing system 60 may be a self-contained unit having the activation member (shown as a knob) and motor connected to one another. The system 60 can have a key lock 150 that allows system 60 to be removed from and replaced onto two-prong system 90. Dispensing system 60 can also be completely locked during busy, high-theft times.

Alternatively, the key lock 150 may be associated with knob 20 to allows a retailer to re-position the forward gate (turning knob) and allow product to be loaded onto the hook by a retail attendant and then locked in the position that allows for vending.

During use of the system shown in FIGS. 5 and 6, when the consumer turns knob 20, a single product is released from lower member 94, and the groove 42 of blocking member 40 engages lower member 94 to prevent further product from being released. The turning of knob 20 also winds the motor 62, which controls the movement of blocking member 40. As discussed above, blocking member 40 may be slowly rotated by the movement of motor 62 (so that once motor 62 times out, blocking member 40 allows another product to be released), or blocking member 40 may remain in a blocked position and then be released in a single, snapping motion once the motor 62 times out or reaches a pre-determined point in its progress.

While a preferred embodiment of the invention has been described, it should be understood that alternate versions may be developed that would fall with in the scope and spirit of the attached claims. For example, it may be possible to use two gates, rather than a knob and a blocking member. The gates could retain products when in the closed position and may be opened by activating a push-button or lever. The spring loaded motor could still be engaged by a spring, although it could also be operated by a circuit board, an electric motor, or any other appropriate device. In this instance, when a consumer presses a dispensing button or activates a dispensing lever, an electric motor could cycle, opening a first gate, allowing a product to be removed, but activating a second gate to prevent more than one product from being dispensed. Once the product has been removed, the spring can snap back to its original position and push the gates closed. In the snap-back embodiment, there may be provided a trigger 152 that snaps and locks when the activation member 20 is turned. When the motor unwinds, it pulls the trigger 152 out from its locked position. Additionally, the time delay may be controlled by a circuit board or a built-in timer, rather than the motor and spring concept.

To further deter theft, device 10 may include a sound to alert store employees that a product is being dispensed. For example, device 10 may include a clicker for providing an audible clicking sound. The clicker may be incorporated into the spring 70 so that the sound is heard when the spring is recoiled when the knob, button or lever is triggered. Additionally or alternatively, device 10 may include an audible beeping sound or an audible message when a product is dispensed. These sounds may alert people in the vicinity that a product is in the position to be removed, attracting the attention of a store clerk and deterring thieves.

While the invention has been described in detail with particular reference to the disclosed embodiments, it will be understood that variations and modifications can be affected within the spirit and scope of the invention as described herein.

What is claimed is:

1. A time-delay display hook system, comprising:

(a) a two-prong system having an upper member and a lower member, the upper member adapted to support a dispensing system and the lower member adapted to support product to be dispensed;

(b) a dispensing system associated with the upper member, the dispensing system comprising a motor, a blocking member, and an activation member, wherein the activation member is adapted to be triggered to release a product to be dispensed from the lower member, wherein upon triggering of the activation member (i) the blocking member is activated to prevent further product from being dispensed and (ii) the motor is activated to prevent further turning of the activation member until the motor times out, providing a time-delay between dispensing of individual products.

2. The time-delay display hook system of claim 1, wherein the blocking member comprises a stop disc.

3. The time-delay display hook system of claim 1, wherein the blocking member has a blocked position and an open position, and wherein activation of the motor turns the blocking member to its blocked position and as the motor runs, the blocking member begins slowly moving away from its blocked position toward its open position, such that when the motor times out, the blocking member is in its open position and permits product to pass.

4. The time-delay display hook system of claim 1, wherein the activation member comprises a knob with a portion to be grasped and a dispensing groove.

5. The time-delay display hook system of claim 1, further comprising a dispensing bar system.

6. The time-delay display hook system of claim 5, wherein the dispensing bar system comprises a support bar and a support pusher.

7. The time-delay display hook system of claim 6, wherein the support pusher comprises an engaging system, wherein the upper member comprises a flat plate, and wherein the engaging system receives the flat plate.

8. The time-delay display hook system of claim 1, further comprising a spring associated with the motor, wherein when the activation member is turned, the spring is wound.

9. The time-delay display hook system of claim 1, wherein the dispensing system comprises a key lock feature.

10. The time-delay display hook system of claim 1, wherein the two-prong system is associated with a mounting member.

11. The time-delay display hook system of claim 1, further comprising a sound producing mechanism for producing an audible sound when product is dispensed.

12. The time-delay display hook system of claim 11, wherein the sound producing mechanism is a mechanically produced clicking sound.

13. The time-delay display hook system of claim 12, wherein the sound producing mechanism is an electronically activated beeping sound.

14. A method of dispensing products comprising:

(a) providing a time-delay display hook system having an upper member and a lower member, the upper member supporting a dispensing system comprising a motor, a blocking member, and an activation member;

(b) providing at least one product supported by the lower member; and (c) triggering the activation member to (i) dispense one of the at least one products from the lower member, (ii) activate the blocking member to prevent further product from being released from the lower member, and (iii) activate the motor to prevent further turning of the activation member until the motor times out.

15. The method of claim 14, further comprising providing a blocking member that is a stop disc.

16. The method of claim 14, further comprising providing a dispensing bar system comprising a support bar and a support pusher, wherein the support pusher helps move the at least one product forward along the lower member.

17. The method of claim 14, further comprising winding a spring associated with the motor when the activation member is turned.

18. The method of claim 14, further comprising providing a time-delay display hook system having a key lock feature.

19. The method of claim 14, further comprising mounting the time-delay display hook system to a support structure using a mounting member.

20. The method of claim 14, further comprising activating a sound producing mechanism for producing an audible sound when the at least one product is dispensed.

* * * * *